United States Patent [19]

Kondo et al.

[11] 4,338,035

[45] Jul. 6, 1982

[54] PRINTER

[75] Inventors: Hiroatsu Kondo, Zushi; Toshiaki Ozawa, Chiba; Yasuaki Yamada, Funabashi, all of Japan

[73] Assignee: Canon Kabushiki Kaisha, Tokyo, Japan

[21] Appl. No.: 176,794

[22] Filed: Aug. 11, 1980

[51] Int. Cl.[3] ..... B41J 1/08

[52] U.S. Cl. ..... 400/144.2; 400/187; 400/320

[58] Field of Search ..... 400/144.1, 144.2, 144, 400/139, 143, 185, 187, 283, 320, 322, 329, 329.3, 664, 668; 318/594, 603, 696

[56] References Cited

U.S. PATENT DOCUMENTS 4,189,244 2/1980 Harrison ..... 400/320 X

FOREIGN PATENT DOCUMENTS 1911226 9/1970 Fed. Rep. of Germany ..... 400/322
2160955 6/1972 Fed. Rep. of Germany ... 400/144.2
1188637 4/1970 United Kingdom ..... 400/144.2

OTHER PUBLICATIONS

"Single Motor Drive for Disk Printer", Meier, IBM Tech. Discl. Bulletin, vol. 20, No. 1, Jun. 1977, pp. 100–101.

"Synchronous Drive with Backspacing", Buslik, IBM Tech. Discl. Bulletin, vol. 3, No. 9, Feb. 1961, pp. 9–10.

"Character Impact Printer Offers Maximum Printing Flexibility", Bump, Hewlett-Packard Journal, vol. 27, No. 10, pp. 19–23, Jun. 1976.

"Impact Printer with Carrier and Character-Selection Apparatus Driven Off Same Motor", Hoskins, IBM Tech. Disc. Bull., vol. 23, No. 2, Jul. 1980, pp. 437–438.

*Primary Examiner*—E. H. Eickholt

*Attorney, Agent, or Firm*—Fitzpatrick, Cella, Harper & Scinto

[57] ABSTRACT

A printer having a mechanism for moving a carriage along a platen and a mechanism for rotating a type wheel to select types is disclosed. The printer has switch for selectively transmitting the driving force from a driving source to either carriage or type wheel.

5 Claims, 5 Drawing Figures

PRINTER

BACKGROUND OF THE INVENTION

1. Field of the Invention

The present invention relates to a printer having a carriage and a type wheel, and particularly, to such a printer that the carriage and type wheel can be driven by one and same driving source while switching over the driving force between the carriage and the type wheel.

2. Description of the Priot Art

With the progress of electronics in these years there is an increasing tendency to electronize a printer by substituting motor, solenoid etc. for mechanical parts of the printer. While the electronized printer has high reliability in operation, it is quite expensive. This is because the motor and electric elements in the control system are much more expensive than conventional mechanical parts and elements.

Another problem involved in such electronized printer is the driving system for driving the type wheel and carriage.

A printing mechanism including the type wheel is mounted on the carriage. Since the inertia moment of the type wheel system can be reduced only to a limited extent, a large and strong driving source such as a large motor is required to rotate the type wheel at a sufficiently high speed enough to perform high speed printing. This results in large mass of the carriage. Therefore, a large and strong motor is inevitably required also to move the carriage.

SUMMARY OF THE INVENTION

Accordingly, it is a general object of the invention to solve the above problems involved in the prior art printers and to provide an electronic printer which is inexpensive and simple in structure.

More specifically, it is an object of the invention to provide a printer comprising a switching mechanism for transmitting the driving force from the driving source to either of the carriage and the type wheel selectively.

It is another object of the invention to provide a printer in which the transmission of the driving force to any one of the carriage and the type wheel is conducted by means of a mechanism provided for braking one of the two members.

To attain the above objects according to the invention there is provided a printer comprising an interlocking system for interlocking the carriage and the type wheel with a single driving motor and a switching mechanism for changing over the application of rotational driving force of the driving motor in such manner that when the carriage is braked said driving force may be used to rotate the type wheel and when the type wheel is braked said driving force may be used to move the carriage.

The interlocking system is composed of a belt driven by the driving motor and a pulley mounted on the carriage and disposed engaged with the belt to rotate the type wheel. The switching mechanism is so disposed as to release the type wheel from braking and to brake the carriage when the switching mechanism is energized with electric current. When no current is conducted to the switching mechanism, then it brakes the type wheel and releases the carriage from braking thereby making the carriage connected with the belt through the engagement part between the pulley and belt.

Other and further objects, features and advantages of the invention will appear more fully from the following description taken in connection with the accompanying drawings.

DESCRIPTION OF PREFERRED EMBODIMENTS OF THE INVENTION

Figure 1:
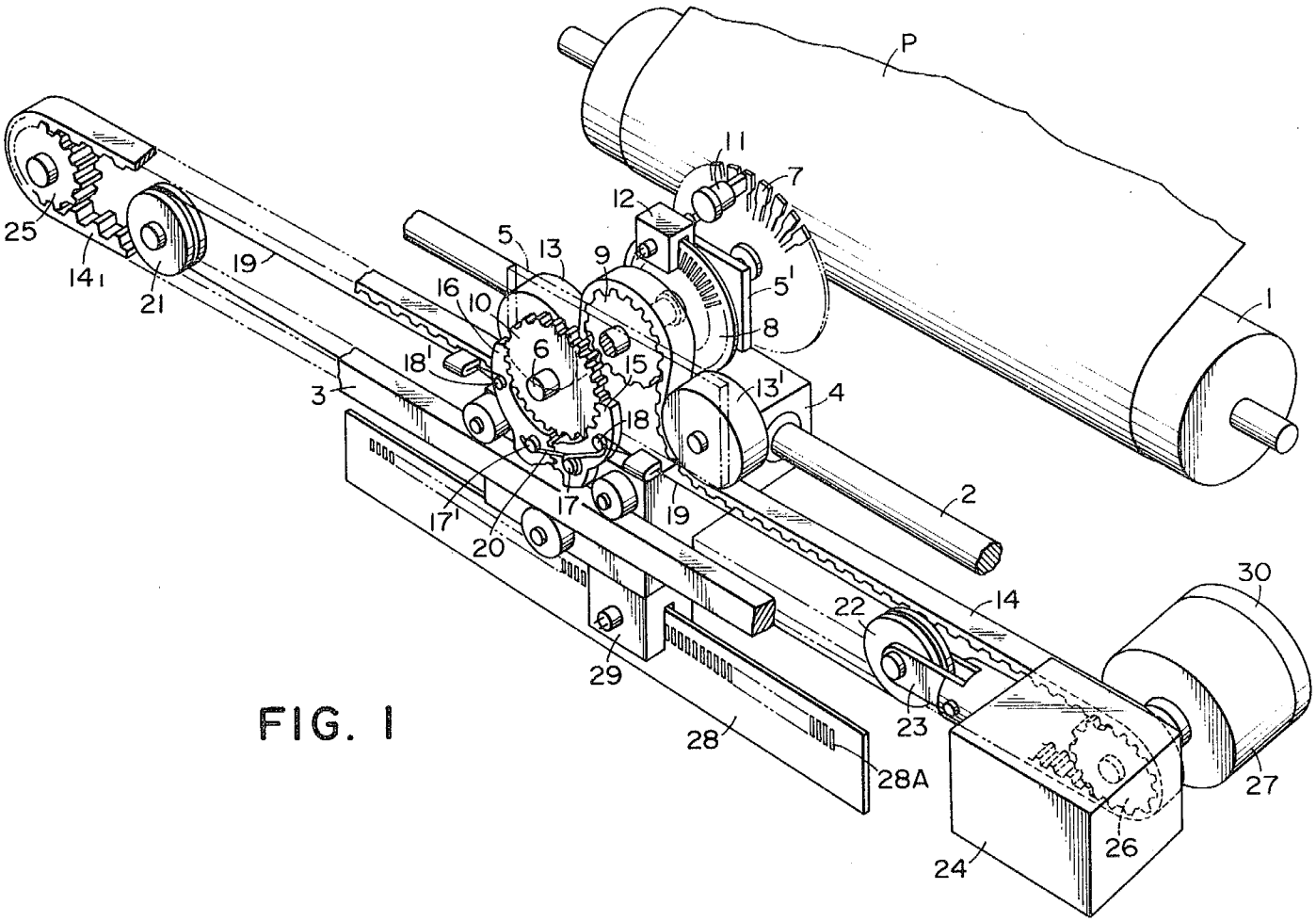
FIG. 1 is a perspective view of the essential part of a printer according to the invention.

In FIG. 1 showing the essential part of a printer according to the invention, reference numeral 1 designates a platen of the printer. P is a printing paper set on the platen, 2 and 3 are guide rails extending in parallel to the platen 1 and 4 is a carriage mounted on the guide rail 2. The carriage is movable along the rail. Provided on the upper surface of the carriage are bearing metals 5 and 5' for rotatably supporting a shaft 6. Mounted on the shaft 6 are a type wheel 7, a slitted disk for detecting type position 8, a driving pulley 9 and a wheel lock ratchet 10. Designated by 11 is a printing hammer and 12 is a type position detector disposed opposite to the slitted disk 8. 13 and 13' are rollers rotatably mounted on the bearing metal 5. The rollers 13 and 13' cooperate together with the pulley 9 to guide a timing belt 14. Designated by 15 and 16 are a pair of ratchet pawls having toothed portions 15C and 16C respectively at which the two pawls are in mesh with each other as shown in Fig. 3. The ratchet pawls 15 and 16 can rotate about pivots 17 and 17' symmetrically relative to the ratchet wheel 10. The pivots 17 and 17' are fixed to the carriage 4. In normal position (when the electric power source is off), the two pawls 15 and 16 are in mesh with the ratchet wheel by their toothed portions 15A and 16A under the biasing force of a torsion coil spring 20 as later described in detail. Therefore, in this position (see FIG. 2), the pawls 15 and 16 lock the ratchet wheel 10 and therefore the type wheel 7.

The ratchet pawls 15 and 16 have pins 18 and 18' fixed thereon respectively. The pins 18 and 18' are pulled by a wire 19 when a switching mechanism is actuated. The above mentioned torsion spring 20 is disposed on the pivots 17, 17' and pins 18, 18' in the manner shown in FIG. 1 so that under the action of the torsion spring 20 the pair of pawls 15 and 16 are in mesh with the ratchet wheel 10. The wire 19 extends around pulleys 21 and 22. The pulley 21 is mounted on a printer frame not shown and the pulley 22 is mounted on a solenoid 24 through a lever 23.

The timing belt 14 is in mesh with gears 25 and 26 and with the toothed pulley 9 of the type wheel system on the carriage 4. The shaft of gear 25 is supported by the printer frame not shown and the gear 26 is connected with the output shaft of a driving motor 27. At the area of carriage 4, the timing belt is guided by guide rollers 13 and 13'. 28 is a stationary slitted plate extending in parallel with the guide rails 2 and 3 and having a number of slits 28A. 29 is a carriage position detector mounted on the carriage 4 with its detecting part being astride of the slitted plate 28 at the level of slits 28A. A rotational speed detecting tachometer generator 30 is mounted on the driving motor 27.

The manner how to lock the type wheel 7 and the carriage 4 will be described hereinafter with reference to FIGS. 2 and 3.

Figure 2:
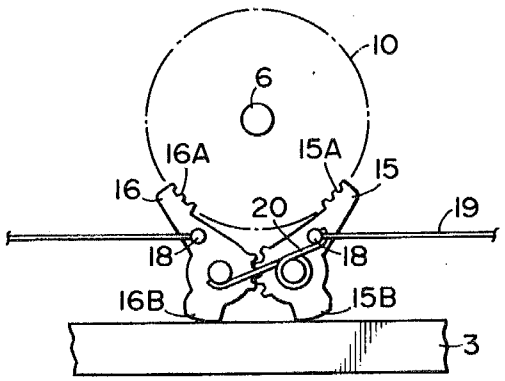
FIGS. 2 and 3 illustrate the manner of operation in the position to brake the type wheel and in the position to brake the carriage respectively.
Figure 3:
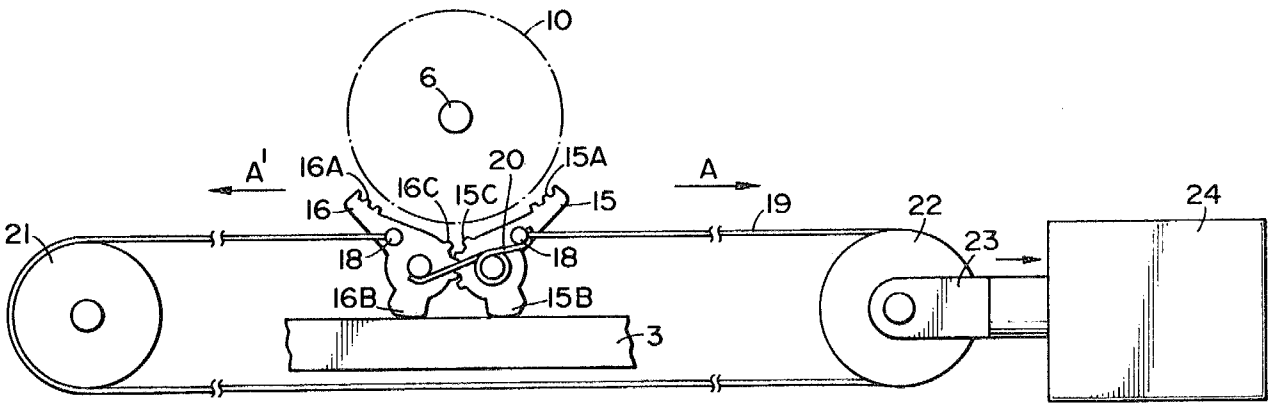

So long as the printer is in its normal operation mode, the ratchet wheel 10 and pawls 15,16 take the position shown in FIG. 2. In this position, the pawls 15, 16 are in mesh with the ratchet wheel 10 so that the latter is not allowed to rotate and therefore the type wheel 7 and the pulley 9 mounted on the same shaft 6 are also held locked. The ratched wheel 10 has the same number of teeth as the number of types on the type wheel 7 and is locked against rotation by the toothed parts 15A and 16A of the ratchet pawls 15 and 16. The positional relation between the ratchet wheel 10 and type wheel 7 is so preset as to align one of the types on the type wheel with the bind line between the printing hammer 11 and the printing position on the paper P. As seen in FIG. 2, in this position, there is provided a narrow space between the guide rail 3 and the ends 15B, 16B of the ratchet pawls 15, 16. Owing to the space the carriage 4 is allowed to slide move along the guide rails 2 and 3. Since, as previously noted, the carriage 4 is operatively connected with the timing belt 14 through the engagement between timing belt 14 and pulley 9, the carriage 4 is moved along the guide rails 2 and 3 when the timing blet 14 is driven by the driving motor 27. The wire 19 extends only around the pulleys 21 and 22 and free rotation is allowed for the pulleys 21 and 22. Therefore, the wire never hinders the carriage 4 from slide moving along the guide rails 2 and 3.

When the solenoid 24 of switching mechanism is energized with electric current applied thereto, the lever 23 connected with the plunger 24 and the pulley 22 connected with the lever are pulled by the solenoid in the direction toward the solenoid. Therefore, the distance between two wire pulleys 21 and 22 are forcedly extended. This position is shown in FIG. 3. As seen from the drawing, the tension acts upon the pin 18 on pawl 15 and pin 18' on pawl 16 through the wire 19 in the directions A and A' respectively. Since the pulling force of solenoid 24 is so predetermined as to be larger than the spring force of torsion coil spring 20 intending a close the two pins 18 and 18' to each other, the former overcomes the latter. Thus, the toothed portions 15A, 16A of pawls 15, 16 are disengaged from the ratchet wheel 10 to unlock the type wheel 7. Almost simultaneously with the unlocking of the type wheel 7, the pawl's ends 15B and 16B are brought into engagement with the guide rail 3 as shown in FIG. 3. Thus, the pawls 15 and 16 and therefore the whole carriage 4 are locked against movement relative to the guide rail 3. In this position, if there is applied any force intending to move the carriage 4 leftward or rightward, then the engagement between the pawl's ends 15B, 16B and the guide rail 3 will be enhanced and therefore the carriage 4 will be locked much more firmly. This is because the ratchet pawls 15 and 16 are in mesh with each other at their toothed portions 15C and 16C.

While in FIGS. 1 and 2 the guide rail 3 has been shown to have a flat and smooth surface, it may have an indented surface or the like. In the position shown in FIG. 3, the carriage 4 is held fixed whereas the ratchet wheel 10, pulley 9 and type wheel 7 are allowed to rotate together freely. The rotation of driving motor 27 is transmitted to the type wheel 7 through the timing belt 14. Therefore, in this position, any selected type on the type wheel can be brought to the printing position by suitably controlling the rotation of motor 27.

Figure 4:
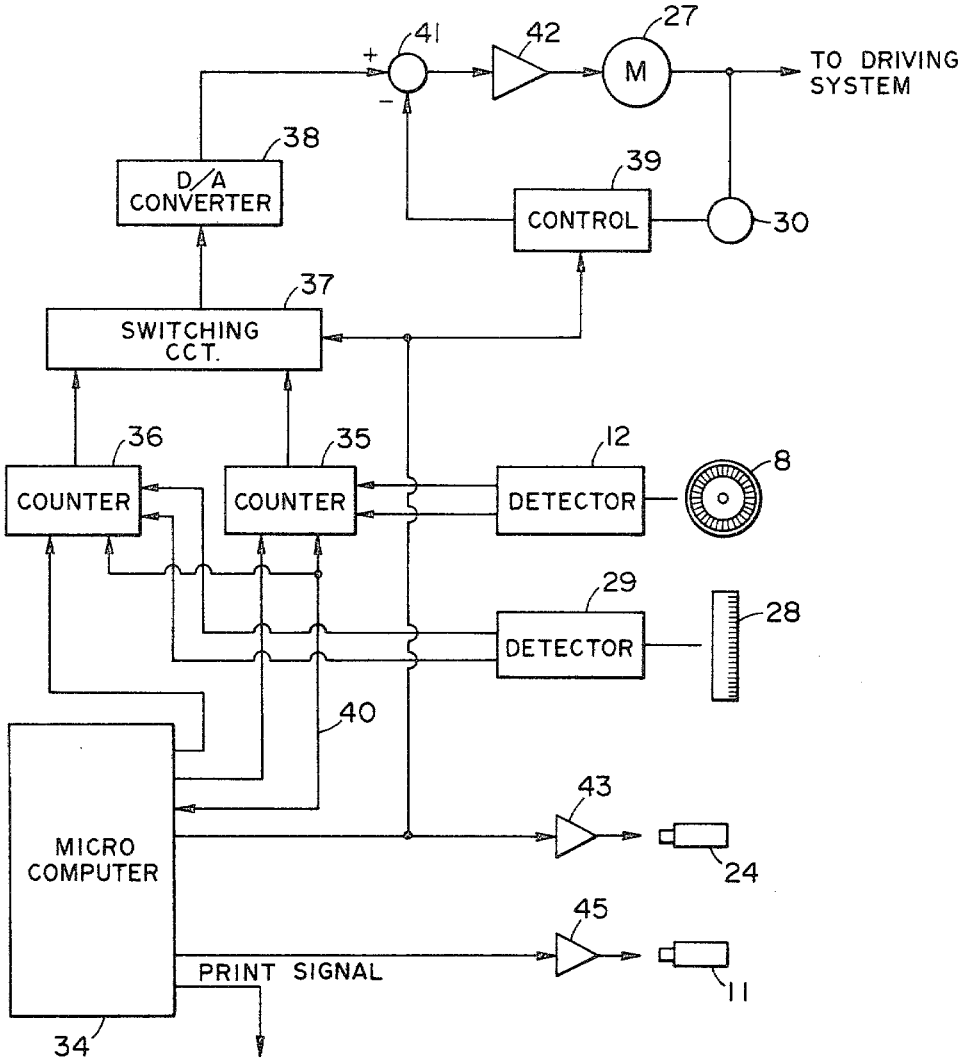
FIG. 4 shows one form of electric control part used in the printer according to the invention.
Figure 5:
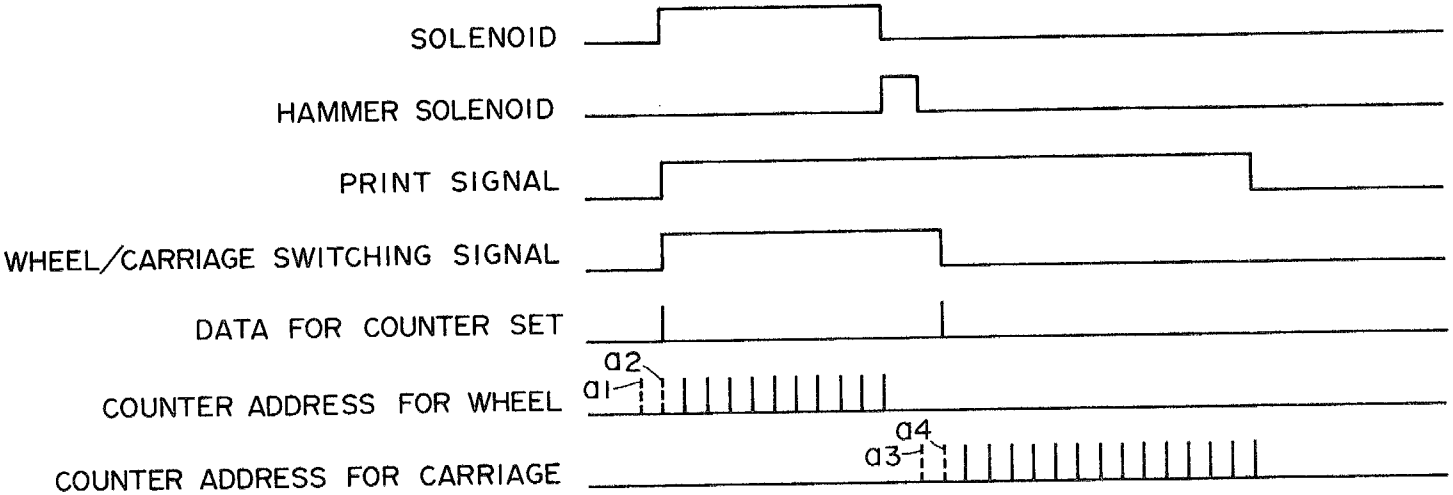
FIG. 5 is a timing chart thereof for illustrating the operation.

As an example, one form of electric control part used for controlling the operation of the above described printer is shown in FIG. 4. FIG. 5 shows its timing chart.

In FIG. 4, the control part comprises a micro computer 34, counters 35 and 36, a switching circuit 37, a D/A converter 38, a speed feedback rate control circuit 39, a summing and subtracting device (for example, differential amplifier) 41 and driving amplifiers 42, 43 and 45. 40 is a data bus. The counter 35 counts position pulses and direction pulses coming from the type position detector 12. The other counter 36 counts position pulses and direction pulses coming from the carriage position detector 29. The switching circuit 37 selects any one of outputs from the counters 35 and 36 in response to a switch signal. The device 41 functions as adder and subtractor for position signal and speed signal.

With the above arrangement of control part, the printer operates in the manner shown in FIG. 5. According as the case then occurring, the timing of carriage movement may be before or after the timing of type wheel selection. Hereinafter, for the purpose of explanation, description will be made starting from such a position in which after printing a certain character in a continuous printing operation, the operator is about to shift the carriage to the next printing position by one spacing.

To this end, a print instruction signal is introduced into the micro computer 34 from an external key board or a digital instrument not shown. When the micro computer receives the print instruction, the print signal is turned to high level. After comparing the instructed character with the character existing in the hold position, the micro computer determines the amount and direction in which the type wheel 7 has to be rotated. The content of the wheel position counter 35 which should naturally be zero is read out through the data bus 40 at the time point of rising of pulse $a_1$ which is indicated by a broken line as the leftwardmost one of counter address for wheel in FIG. 5. By reading it, the amount of rotation previously set on type wheel 7 is corrected for the next one. The correction value is set anew to the wheel position counter 35 through the data bus 40 at the rise time of the second pulse $a_2$ indicated by a broken line in the counter address for wheel. Immediately after setting the correction value, the micro computer 34 issues a wheel/carriage switching signal. This switching signal is applied to the solenoid 24 through the amplifier 43 to actuate the solenoid. As a result, in the manner previously described, the carriage 4 is locked and the type wheel 7 is unlocked. At the same time, the switching signal, when it is at high level, makes the wheel position counter 35 connected to D/A converter 38 and when at low level it makes the carriage position counter 36 connected to D/A converter through the switching circuit 37 so as to produce the corresponding position signal respectively.

Inertia load and friction load applied to the motor 27 when it is driving the type wheel 7 and those applied when driving the carriage 4 are different from each other in amount. Therefore, the speed feed back required to give a critical brake is also different in amount between the two operation modes. To accommodate the difference, the above wheel/carriage switching signal is introduced into the speed feed back rate control 39 through which the amount of speed feed back from the tachometer generator 30 connected with the driving motor 27 is so controlled as to give the critical brake required at that time.

After the solenoid 24 is actuated to unlock the type wheel, the latter rotates to make the content of wheel position counter 35 zero. This rotation of type wheel 7 is detected by the slitted disk 8 and detector 12 as position pulse and direction pulse which are put into the position counter 35.

The micro computer 34 continues watching the content of the counter 35 (see solid line pulses of counter address for wheel in FIG. 5). When the content of the counter becomes smaller than the set value, namely when the type wheel has rotated near the aimed position, the solenoid 24 is deenergized to lock the type wheel 7 taking into account the time lag at the solenoid. Immediately after the type wheel being locked, the micro computer 34 actuates the printing hammer 11 taking into account the flying time of hammer so as to make the printing hammer strike the selected type to effect printing in good timing.

After the lapse of time required for flying and returning of the printing hammer 11, the micro computer 34 makes a correction to the amount of movement necessary for shifting the carriage 4 to the next printing position. To this end, at the rise time of leftwardmost pulse $a_3$ indicated by a broken line in counter address for carriage shown in FIG. 5, reading of data is carried out from the carriage position counter 36 through the data bus 40 to determine the necessary correction value. The correction value is anew set to the counter 36 at the rising time of the second pulse $a_4$ indicated by a broken line in the counter address for carriage. At the same time, the wheel/carriage switching signal is turned to low level. Thereby the content of the carriage position counter 36 is transformed into a position signal by D/A converter 38 through the switching circuit 37. The amount of speed feed back in the control loop of the driving motor 27 is adjusted to a value suitable for driving the carriage by the speed feed back rate to control 39. In this position, the carriage 4 starts moving to the next printing position. This movement of the carriage is detected by the slitted plate 28 and detector 29 as position pulse and direction pulse which are put into the position counter 36. When the content of the counter 36 reaches within the allowable range of error for stopping, the micro computer 34 turns the print signal to low level and keeps the waiting position until the arrival of the next print instruction.

While in the shown embodiment the motor 27 has been described to be a servo motor, a pulse motor also may be used. In the embodiment described above, there is a short transition period (an intermediate position between the positions shown in FIGS. 2 and 3) in which both of the type wheel 7 and the carriage 4 are in unlocked position. In this short transition period of switching operation, the motor 27 is stopping and therefore the type wheel 7 and carriage 4 remain stationary. The embodiment may be modified to keep the type wheel and carriage locked even in the transition period although this modification will make the structure of the ratchet part complicated.

As understood from the foregoing, the present invention brings forth many advantages over the prior art.

In the printer of the invention, the type wheel and the carriage are alternately driven by one and single driving motor employing a simple power transmission switching mechanism comprising only one solenoid. The mass of carraige is essentially reduced and therefore a smaller driving motor can be used in the printer. As a whole, the printer according to the invention is light in weight and low in manufacturing cost. Since it is simple in structure and operation, it has few troubles.

Since the type wheel is held locked even when the electric power source is off, unintentional movement of the carriage can be prevented in this position. On the other hand, in this position, the carriage can be moved at the operator's will (the motor can be rotated freely so long as no current flows through it). There occurs no trouble of the machine being damaged by the ratchet pawls 15, 16 biting in the guide rail 3 too much. Since the carriage can be moved even when the power is off, the operator can conveniently exchange old type ribbon for new one.

While the invention has been particularly shown and described with reference to preferred embodiments thereof, it will be understood by those skilled in the art that the foregoing and other changes in form and details can be made therein without departing from the spirit and scope of the invention.

What we claim is:

1. A printer provided with a carriage movable parallel with an axis of a platen for advancing a recording medium, comprising:

a shaft rotatably mounted on said carriage;

a character wheel fixed on said shaft;

a pulley fixed on said shaft; and means having a first state for inhibiting rotation of said shaft and thereby causing movement of said carriage and having a second state for inhibiting movement of said carriage and thereby causing rotation of said shaft; said means comprising a guide member parallel with said axis of said platen for guiding said carriage, a rotatable member fixed on said shaft and an engaging member for engaging said rotatable member in said first state and for engaging said guide member in said second state.

2. A printer according to claim 1, wherein said rotatable member comprises a gear.

3. A printer according to claim 2, wherein said engaging member comprises at least one ratched pawl.

4. A printer according to claim 2, wherein said engaging member comprises a pair of ratchet pawls.

5. A printer according to claim 4, wherein each of said pair of ratchet pawls has a plurality of teeth for engagement with a plurality of teeth of said gear.

* * * * *

UNITED STATES PATENT OFFICE

CERTIFICATE OF CORRECTION

Patent No. 4,338,035 Dated July 6, 1982

Inventor(s) HIROATSU KONDO, ET AL.

It is certified that error appears in the above-identified patent and that said Letters Patent are hereby corrected as shown below:

Column 1, line 13, change "Priot" to --Prior--.

Column 3, line 14, change "ratched" to --ratchet--.

Column 3, line 30, change "blet" to --belt--.

Column 3, line 47, change "a" to --to--.

Column 6, line 12, change "carraige" to --carriage--.

IN THE CLAIMS

Column 6, line 54, change "ratched" to --ratchet--.

Signed and Sealed this

Seventh Day of December 1982

[SEAL]

Attest:

GERALD J. MOSSINGHOFF

Attesting Officer

Commissioner of Patents and Trademarks